US009058016B2

(12) United States Patent
Hamaya et al.

(10) Patent No.: US 9,058,016 B2
(45) Date of Patent: Jun. 16, 2015

(54) PRINTING APPARATUS

(71) Applicants: Masahito Hamaya, Aichi (JP); Tasuku Sugimoto, Aichi (JP); Kentaro Sugiyama, Gifu (JP); Osamu Takahashi, Aichi (JP)

(72) Inventors: Masahito Hamaya, Aichi (JP); Tasuku Sugimoto, Aichi (JP); Kentaro Sugiyama, Gifu (JP); Osamu Takahashi, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 68 days.

(21) Appl. No.: 13/828,548

(22) Filed: Mar. 14, 2013

(65) Prior Publication Data

US 2013/0259494 A1 Oct. 3, 2013

(30) Foreign Application Priority Data

Mar. 28, 2012 (JP) ..... 2012-073419

(51) Int. Cl.
*G03G 15/00* (2006.01)
*G03G 21/18* (2006.01)

(52) U.S. Cl.
CPC .... *G03G 21/1832* (2013.01); *G03G 2221/1609* (2013.01); *G03G 21/181* (2013.01); *G03G 2215/0141* (2013.01)

(58) Field of Classification Search
CPC ..... G03G 21/1604; G03G 21/181; G03G 21/1828; G03G 21/1832; G03G 2221/1609
USPC ..... 399/81, 110
See application file for complete search history.

(56) References Cited

U.S. PATENT DOCUMENTS

| | | | | |
|---|---|---|---|---|
| 5,289,233 | A * | 2/1994 | Sakamoto et al. | 399/107 |
| 5,953,561 | A * | 9/1999 | Tashiro et al. | 399/111 |
| 2005/0019062 | A1* | 1/2005 | Kang et al. | 399/114 |
| 2005/0169664 | A1 | 8/2005 | Arimitsu et al. | |
| 2006/0216064 | A1* | 9/2006 | Koumoto et al. | 399/111 |
| 2010/0209137 | A1* | 8/2010 | Takiguchi et al. | 399/111 |

FOREIGN PATENT DOCUMENTS

| | | | |
|---|---|---|---|
| JP | 11-218983 | A | 8/1999 |
| JP | 2005-242332 | A | 9/2005 |
| JP | 2006-154617 | A | 6/2006 |
| JP | 2007-248851 | A | 9/2007 |
| JP | 2009-265147 | A | 11/2009 |

* cited by examiner

*Primary Examiner* — Benjamin Schmitt
(74) *Attorney, Agent, or Firm* — Scully, Scott, Murphy & Presser, PC

(57) ABSTRACT

A printing apparatus to print an image on a sheet is provided. The printing apparatus includes a photosensitive member, a contiguous member arranged to contact the photosensitive member, and a protection sheet configured to protect the photosensitive member from the contiguous member. The protection sheet is arranged in an intervening position between the photosensitive member and the contiguous member but configured to be removed from the intervening position by a user before using the printing apparatus. The protection sheet interferes with at least one of the user's behavior conducted on the printing apparatus in order to use the printing apparatus and a detecting behavior of a sensor which is arranged in the printing apparatus to detect a condition of the printing apparatus.

4 Claims, 10 Drawing Sheets

PRINTING APPARATUS

CROSS REFERENCE TO RELATED APPLICATION

This application claims priority from Japanese Patent Application No. 2012-073419, filed on Mar. 28, 2012, the entire subject matter of which is incorporated herein by reference.

BACKGROUND

1. Technical Field

An aspect of the present invention relates to a method for protecting a photosensitive member in a printing apparatus from being collided with a contiguous member by a protection sheet during transportation.

2. Related Art

In a conventionally known image forming apparatus, having a photosensitive member and a contiguous member such as an intermediate belt, a protection sheet may be interposed between the photosensitive member and the contiguous member in order to protect the two members from being collided with each other. When a user attempts to use the image forming apparatus, presence of the protection sheet may be alerted to the user by an alert tag, which may be placed hanging from an intermediate position between a cover and a chassis of the image forming apparatus so that the user can remove the protection sheet before using the image forming apparatus.

SUMMARY

Even with the alert tag, however, the user may start using and activating the image forming apparatus without removing the protection sheet with or without knowing the presence of the protection sheet. In such a case, an image forming operation may be attempted with the protection sheet interposed between the photosensitive member and the contiguous member, and the protection sheet may now damage the photosensitive member and the contiguous member as the photosensitive member and the contiguous member move respectively.

In view of such consideration, the present invention is advantageous in that an image forming apparatus, in which execution of an image forming operation is prevented when the protection sheet is not removed, is provided.

According to an aspect of the present invention, a printing apparatus to print an image on a sheet is provided. The printing apparatus includes a photosensitive member, a contiguous member arranged to contact the photosensitive member, and a protection sheet to protect the photosensitive member from the contiguous member. The protection sheet is arranged in an intervening position between the photosensitive member and the contiguous member but is configured to be removed from the intervening position by a user before using the printing apparatus. The protection sheet interferes with at least one of the user's behavior conducted on the printing apparatus in order to use the printing apparatus and a detecting behavior of a sensor which is arranged in the printing apparatus to detect a condition of the printing apparatus.

According to another aspect of the present invention, a printing apparatus configured to print an image on a sheet is provided. The printing apparatus includes a belt unit including a driving roller, a driven roller, and a conveyer belt extended around the driving roller and the driven roller, a photosensitive member, a cartridge accommodating section having an opening through which a cartridge is detachably attachable, and a protection sheet. A first part of the protection sheet is arranged in between the photosensitive member and the conveyer belt to prevent the photosensitive member from contacting the conveyer belt. A second part of the protection sheet covers the opening of the cartridge accommodating section.

According to another aspect of the present invention, a printing apparatus configured to print an image on a sheet is provided. The printing apparatus includes a casing; a belt unit disposed in the casing, the belt unit including a driving roller, a driven roller, and a conveyer belt extended around the driving roller and the driven roller, a photosensitive member disposed in the casing, an operation panel disposed on an outer surface of the casing, the operation panel including a plurality of operation buttons and a display, and a protection sheet. A first part of the protection sheet is arranged in between the photosensitive member and the conveyer belt to prevent the photosensitive member from being in contact with the conveyer belt. A second part of the protection sheet covers the operation panel.

BRIEF DESCRIPTION OF THE ACCOMPANYING DRAWINGS

DETAILED DESCRIPTION

Hereinafter, embodiments of the present invention will be described with reference to the accompanying drawings.

First Embodiment

A first embodiment of the present invention will be described with reference to FIGS. 1-4.

1. Overall Configuration of the Printer

Figure 1:
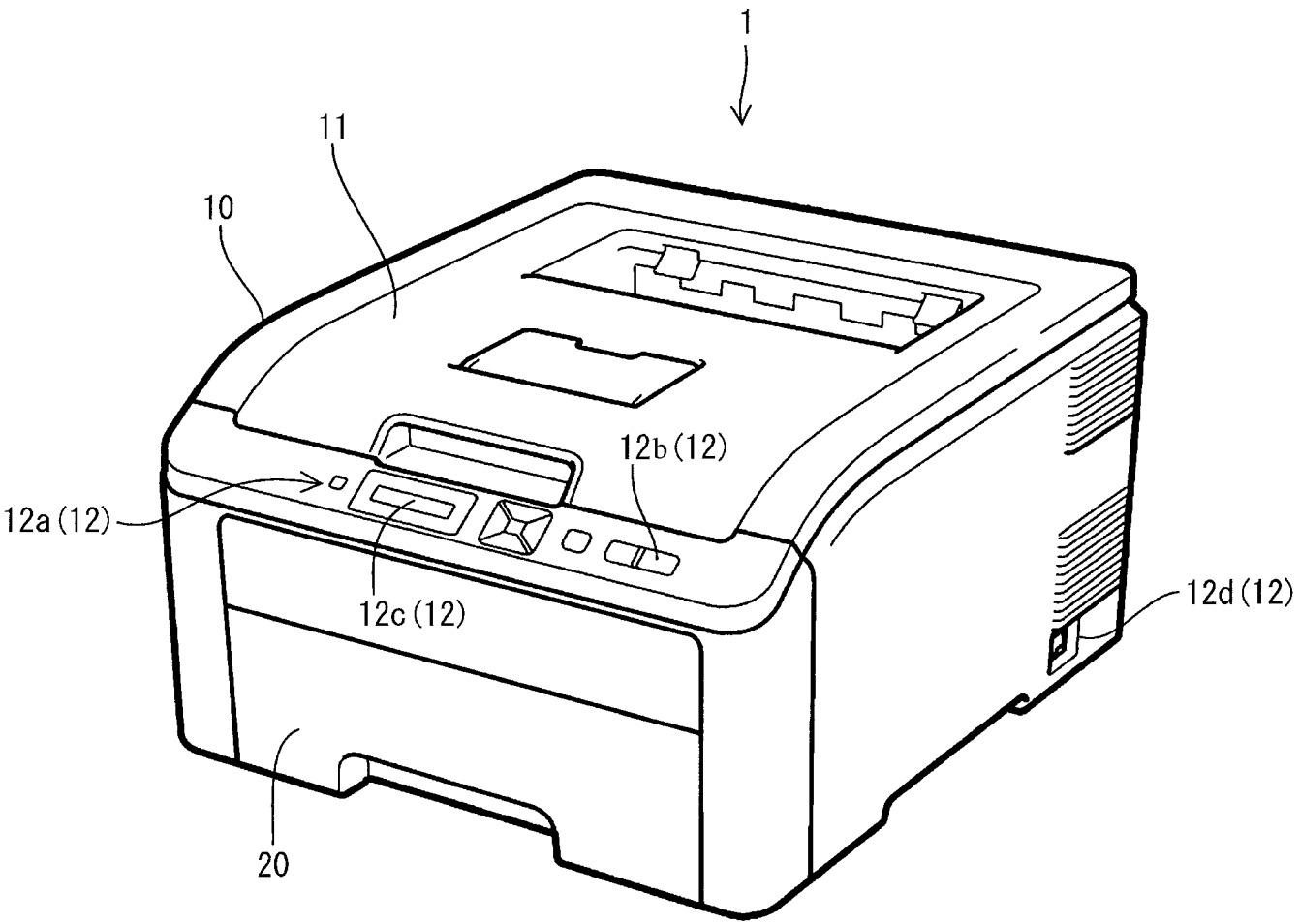
FIG. 1 is a perspective view of a printer according to a first embodiment of the present invention.

An overall configuration of a printer 1 according to the first embodiment of the present invention will be described with reference to FIG. 1. The printer 1 is a tandem-typed printing apparatus for forming an image on a printing sheet in an electrophotographic printing method.

The printer 1 has a main casing 10, which is formed to have a shape of a top-open box, and a cover 11, which is coupled to the main casing 10. The cover 11 is openable/closable with respect to the main casing 10 to uncover and cover an opening 10*a* (see FIG. 4) at the top of the main casing 10. The cover 11 can serve as a discharge tray, in which a sheet with a printed image is placed.

In the main casing 10, on a front side with respect to the cover 11, an operation panel 12*a* is arranged. The operation panel 12*a* includes a plurality of operation buttons 12*b* and a liquid crystal display 12*c*. A user may touch and operate the operation panel 12*a* to manipulate behaviors of the printer 1 and input settings concerning the behaviors of the printer 1. In a lower lateral position of the main casing 10, a power switch 12*d* is arranged. The operation panel 12*a* and the power switch 12*d* are parts of an operation unit 12, through which instructions from the user are entered.

The printer 1 includes a sheet storage 20, in which printing sheets M to have images printed thereon are stored. The sheet storage 20 is arranged in a frontward position in the printer 1 and can be drawn out of the printer 1 when, for example, new stack of sheets are supplied in the sheet storage 20.

2. Internal Configuration of the Printer

Figure 2:
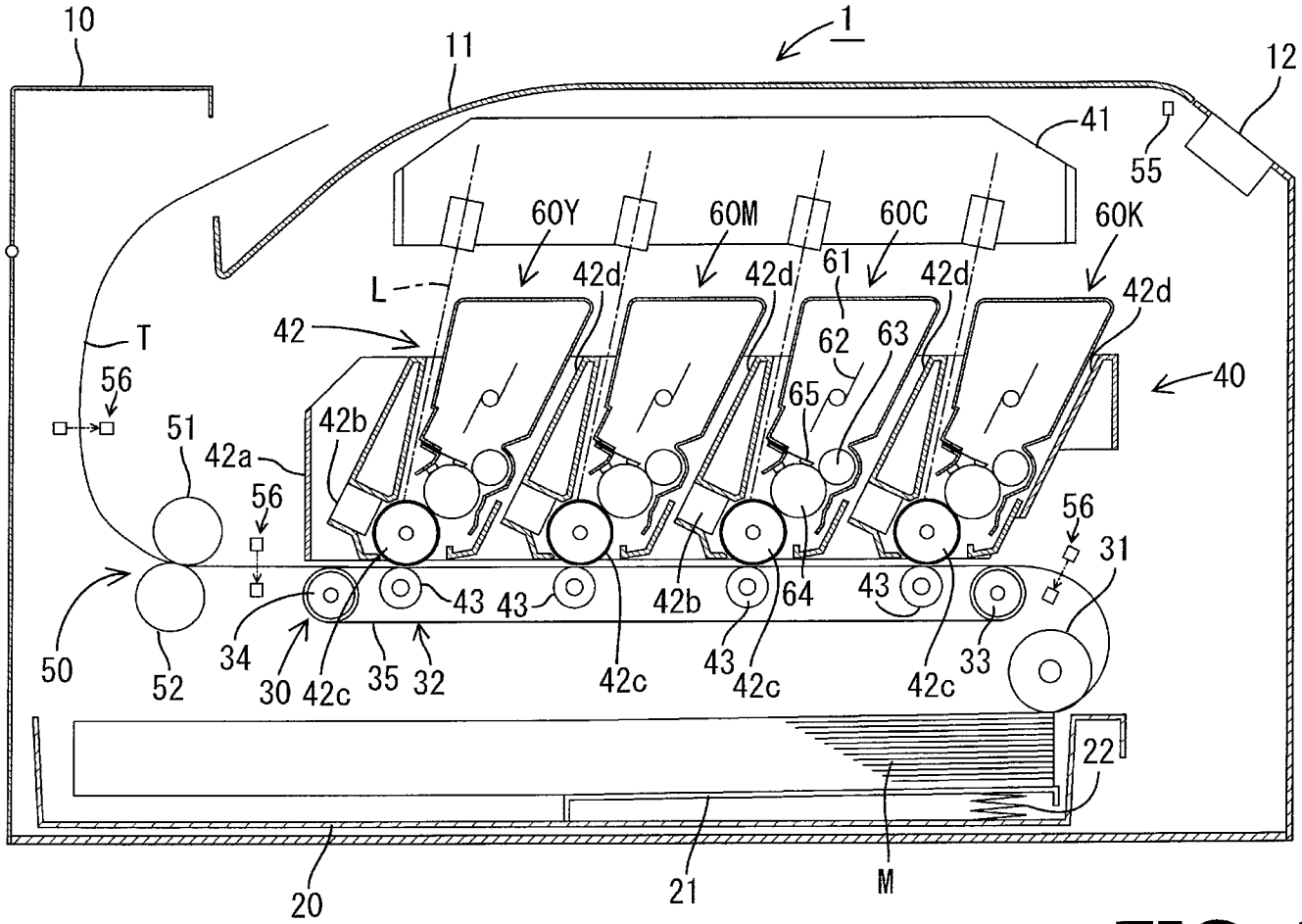
FIG. 2 is a cross-sectional side view of the printer according to the first embodiment of the present invention.

An internal configuration of the printer 1 will be described with reference to FIG. 2. As shown in FIG. 2, the printer 1 includes the sheet storage 20, a conveyer unit 30, a printing unit 40, a fixing unit 50, a cover open/close sensor 55, and a plurality of sheet-jam sensors 56. The printer 1 further includes a control unit 71 and a communication interface unit 72, which are omitted in FIG. 2 but shown in FIG. 3.

The sheet storage 20 includes a sheet tray 21, in which the sheets M are stacked, and a spring 22, which provides urging force against the sheet tray 21 to resiliently uplift the sheet tray 21. As the sheet tray 21 is uplifted by the spring 22, a topmost sheet among the stacked sheets M in the sheet tray 21 is urged against a pickup roller 31.

The conveyer unit 30 includes the pickup roller 31 and a belt unit 2. The conveyer unit 30 conveys the sheets M stored in the sheet storage 20 one-by-one along a conveyer path T. The belt unit 32 includes a driving roller 33, a driven roller 34, and a conveyer belt 35. The conveyer belt 35 is an endless belt extended around the driving roller 33 and the driven roller 34. The conveyer belt 35 is arranged to be contiguous with photosensitive drums 42*c*, which will be described below in detail.

The printing unit 40 includes a scanner unit 41, a drum cartridge 42, and transfer rollers 43. The printing unit 40 forms an image in the electrophotographic printing method on the sheet M being conveyed by the conveyer unit 30.

The scanner unit 41 includes laser emitters (not shown), which emit laser beams L, polygon mirrors (not shown), which polarize the laser beams L, and an optical system (not shown). In the scanner unit 41, surfaces of photosensitive drums 42*c* are exposed to the laser beams L based on image signals output from a control unit 71 (see FIG. 3). The scanner unit 41 is fixed to the cover 11 and can be uplifted along with the cover 11 when the cover 11 opens. Alternatively to the laser emitters, the scanner unit 41 may have LEDs to emit lights and expose the photosensitive drums 42*c* to the lights emitted from the LEDs.

The drum cartridge 42 includes a frame 42*a*, chargers 42*b*, and the photosensitive drums 42*c*, and is detachably attached to the printer 1. The frame 42*a* is formed to have four toner cartridge attachable sections 42*d*. Four toner cartridges 60 including toner cartridges 60Y, 60M, 60C, 60K for yellow, magenta, cyan, and black, are attached to fit in each of the toner cartridge attachable sections 42*d*. The configuration of the toner cartridges 60 will be described later in detail.

The charger 42*b* and the photosensitive drum 42*c* are arranged in each of the toner cartridge attachable sections 42*d*. Each photosensitive drum 42*c* is a cylindrical roller, which extends along a main scanning direction (e.g., a direction of depth in FIG. 2), and each outer periphery of the photosensitive drums 42*c* forms a photosensitive layer. The charger 42*b* is an electric charger of, for example, a scorotoron-type. The charger 42*b* positively charges the outer peripheral surface of the photosensitive drum 42*c* evenly.

After being charged evenly by the charger 42*b*, the outer peripheral surface of the photosensitive drum 42*c* is exposed to the laser beam L, which is emitted from the scanner unit 41 based on the image signals. Thus, a static latent image is formed on the outer peripheral surface of the photosensitive drum 42*c*. The latent image is thereafter developed with toner supplied from the toner cartridge 60, and a toner image is formed on the outer peripheral surface of the photosensitive drum 42*c*.

The transfer rollers 43 are arranged in opposite positions with respect to the photosensitive drums 42*c* respectively across the conveyer belt 35. As the sheet M being conveyed by the belt unit 32 passes through transfer positions between the photosensitive drums 42*c* and the transfer rollers 43, the toner images formed on the outer peripheral surfaces of the photosensitive drums 42*c* are transferred onto the sheet M by negative transfer bias applied to the transfer rollers 43.

The fixing unit 50 includes a heat roller 51, which includes a heat source (e.g., a halogen lamp) inside, and a driven roller 52, which is pressed against the heat roller 51 and rotated along with rotation of the heat roller 51. The toner images transferred onto the sheet M is thermally fixed thereat as the sheet M passes through a midst position between the heat roller 51 and the driven roller 52. The sheet M with the thermally fixed images is thereafter discharged to rest on the discharge tray, which is formed in the cover 11.

The cover open/close sensor 55 is a sensor, which detects a condition (an open or closed state) of the cover 11. The cover open/close sensor 55 may be, for example, a mechanical switch, which is turned off when the cover 11 is open and turned on when the cover 11 is closed.

The sheet-jam sensors 56 are sensors, which can detect presence of the sheet M in respective detectable ranges along the conveyer path T. The sheet-jam sensor 56 may be, for example, a photoelectric sensor including a light emitter and a light receiver, which are arranged on each side of the conveyer path T. The light emitted from the light emitter toward the light receiver may be received by the light receiver when no sheet M is in the detectable range, and the light receiver may output signals indicating absence of the sheet M to the control unit 71. When the sheet M is in the detectable range, the sheet M may intercept the light, and signals indicating presence of the sheet M may be output to the control unit 71. Alternatively, for example, the sheet-jam sensor 56 may be a mechanical switch, which is pressed by the sheet M and turned on when the sheet M in the detectable range and released from the pressure to be turned off when the sheet M is out of the detectable range. Still alternatively, the sheet-jam sensor 56 may include a photoelectric sensor including an actuator (not shown), which rotates along with movement of the sheet M being conveyed in the conveyer path T. In such a configuration, the sheet-jam sensor 56 may detect presence of the sheet M as the actuator rotates.

3. Configuration of the Toner Cartridges

The toner cartridges 60 are configured to be identical except the colors of the toners being contained therein. Therefore, in the description below, the toner cartridge 60C representing the toner cartridges 60 will be described. The toner cartridge 60C includes a toner container 61, an agitator 62, a supplier roller 63, a developer roller 64, and a spreader blade 65.

The toner container 61 stores a non-magnetic positively-chargeable toner, which can be stirred by the agitator 62 as the agitator 62 rotates. The stirred toner is supplied to the developer roller 64 as the supplier roller 63 rotates.

As the developer roller 64 rotates, the toner supplied to the developer roller 64 enters a midst position between the spreader blade 65 and the developer roller 64 and is spread substantially evenly in a layer on an outer periphery of the developer roller 64. Thus, the toner is carried by the developer roller 64. The toner is thereafter supplied to the latent image formed on the outer periphery of the photosensitive drum 42*c* and forms the toner image.

4. Electrical Configuration of the Printer

Figure 3:
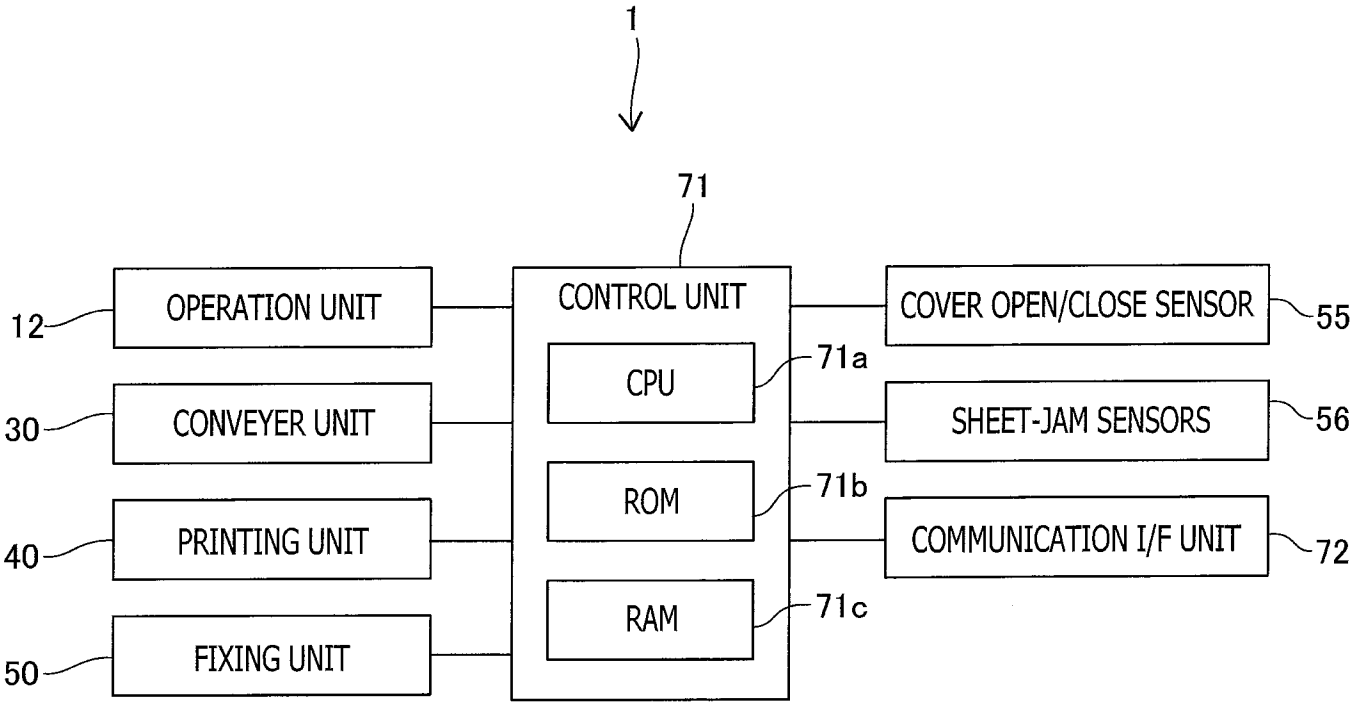
FIG. 3 is a block diagram to illustrate an electrical configuration of the printer according to the first embodiment of the present invention.

An electrical configuration of the printer 1 will be described with reference to FIG. 3. The printer 1 includes the afore-mentioned operation unit 12, the conveyer unit 30, the printing unit 40, the fixing unit 50, the cover open/close sensor 55, and the sheet-jam sensors 56. Further, the printer 1 includes the control unit 71 and a communication interface (I/F) unit 72.

The control unit 71 includes a CPU 71*a*, a ROM 71*b*, and a RAM 71*c*. The ROM 71*b* stores programs to be executed by the CPU 71*a* and data to be used in the programs. The CPU 71*a* controls behaviors of the unit components in the printer 1 by executing the programs stored in the ROM 71*b*. The RAM 71*c* is a memory device, which provides work spaces for the CPU 71*a* executing the programs.

The communication interface unit 72 connects the printer 1 with terminal devices (not shown) to communicate each other through communication networks such as a local area network (LAN) and the Internet and receives a print job from the terminal devices. Optionally or additionally, the communication I/F unit 72 and the terminal devices may be connected with each other via universal serial buses (USB) and/or parallel communication cables.

5. Protection Sheet

Figure 4:
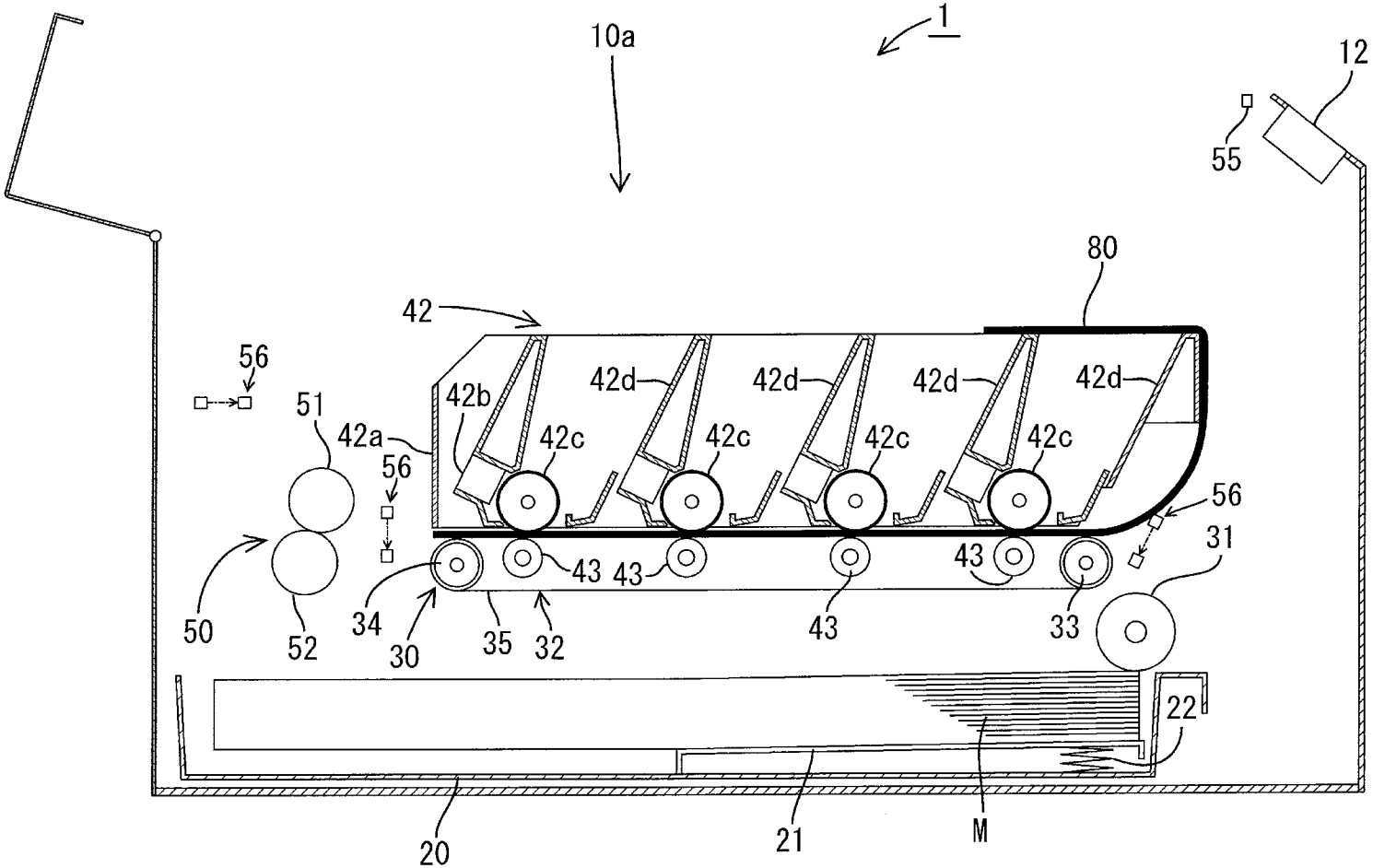
FIG. 4 is a cross-sectional side view of an internal structure of the printer according to the first embodiment of the present invention.

Next, a protection sheet 80 will be described with reference to FIG. 4, in which the printer 1 with the cover 11 being open is shown. In FIG. 4, the protection sheet 80 is emphasized in a thick line for clarity. When the printer 1 is in a factory default condition, the drum cartridge 42 is installed in the printer 1, and the toner cartridges 60 are detached from the drum cartridge 42.

However, with the drum cartridge 42 being installed in the printer 1, when the printer 1 is shipped from the factory, the photosensitive drums 42*c* and the conveyer belt 35 being in contact with each other may collide due to vibration during the transportation, and the photosensitive drums 42*c* may be damaged. Further, extraneous materials may adhere and damage the photosensitive drums 42*c* and the conveyer belt 35. In order to avoid such damages, therefore, the protection sheet 80 is interposed in an intervening position between the conveyer belt 35 and the photosensitive drums 42*c*. The protection sheet 80 may be made of, for example, paper or resin while the photosensitive drums 42*c* are protected from the conveyer belt 35.

The protection sheet 80 is formed to have a width, along the main scanning direction, which is greater than a length of the photosensitive drums 42*c* along the main scanning direction. Therefore, with the protection sheet 80, the photosensitive drums 42*c* are prevented from being in contact with the conveyer belt 35 entirely along the main scanning direction.

Although the protection sheet 80 may be useful to protect the photosensitive drums 42*c* during the transportation, it is necessary that a user removes the protection sheet 80 before using and activating the printer 1. Meanwhile, the user may not notice presence of the protection sheet 80 and instruct the printer to start a printing operation without removing the protection sheet 80. For example, the user may transmit a print job from the terminal device to the printer 1 without removing the protection sheet 80.

Therefore, the protection sheet 80 according to the present embodiment is arranged to interfere the user with the behaviors for attaching the toner cartridges 60 to the toner cartridge attachable sections 42*d* while the toner cartridges 60 need to be attached to the toner cartridge attachable sections 42*d* in order to use the printer 1. More specifically, the protection sheet 80 is located in the intervening position between the photosensitive drums 42*c* and the conveyer belt 35 to prevent the contact of the photosensitive drums 42*c* with the conveyer belt 35, with a part of the protection sheet 80 being extended to cover the top aperture of one of the toner cartridge attachable sections 42*d*, to which the toner cartridge 60K is attached, and adhesively fixed thereat by, for example, adhesive tapes and an adhesive agent.

The protection sheet 80 may not necessarily cover the top apertures of all of the toner cartridge attachable sections 42*d* but should be arranged over at least one of the photosensitive drums 42*c* and one of the toner cartridge attachable sections 42*d* to cover at least one of the top apertures, and the protection sheet 80 should be placed in a position to interfere with the user's attaching behavior conducted on the printer 1.

As has been mentioned above, the toner cartridge 60 is not installed in the toner cartridge attachable section 42*d* in the initial condition when the printer 1 is shipped out of the factory, and it is necessary that the user installs the toner cartridge 60 in the toner cartridge attachable section 42*d* before using the printer 1. Meanwhile, the toner cartridge 60 is prevented from being attached to the toner cartridge attachable section 42*d* by the protection sheet 80 covering the top aperture of the toner cartridge attachable section 42*d* (see FIG. 4).

Thus, in order to attach the toner cartridge 60 to the toner cartridge attachable section 42*d*, the user can be aware of the necessity of removing the protection sheet 80 from the top aperture at a glance. In other words, the user can recognize an intention of the manufacturer of the printer 1 that a printing operation without removing the protection sheet 80 should be avoided. As a result, the protection sheet 80 can be cleared out from the toner cartridge attachable section 42*d* by the user.

As shown in FIG. 4, in the present embodiment, the protection sheet 80 is arranged to cover one of the plurality of toner cartridge attachment sections 42*d* rather than covering all the top apertures of the four toner cartridges 42*d*. This is because covering the one toner cartridge section 42*d* may be enough for the user to note that the protection sheet 80 needs to be removed. However, the protection sheet 80 may cover two or more apertures of the toner cartridge attachable sections 42*d*.

6. Advantages

According to the printer 1 described in the first embodiment, the user's behavior to attach the toner cartridge 60 to the toner cartridge attachable section 42*d* is interfered with by the protection sheet 80; therefore, the user is urged to remove the protection sheet 80. Thus, the printer 1 can prevent a printing operation from being started without removing the protection sheet 80.

According to the printer 1 described in the first embodiment, the protection sheet 80 is arranged in the drum cartridge 42 to cover the photosensitive drums 42*c* and the toner cartridge attachable section 42*d*. Therefore, the user's behavior to attach the toner cartridge 60 to the toner cartridge attachable section 42*d* is interfered with by the protection sheet 80.

According to the printer 1 described in the first embodiment, the protection sheet 80 is arranged to cover the plurality of photosensitive drums 42*c* and a part of the plurality of toner cartridge attachable sections 42*c*. While covering a part of the plurality of toner cartridge attachable sections 42*c*, the protection sheet 80 can be formed in a smaller shape compared to a protection sheet which covers the plurality of toner cartridge attachable sections 42*c* entirely.

Second Embodiment

Figure 5:
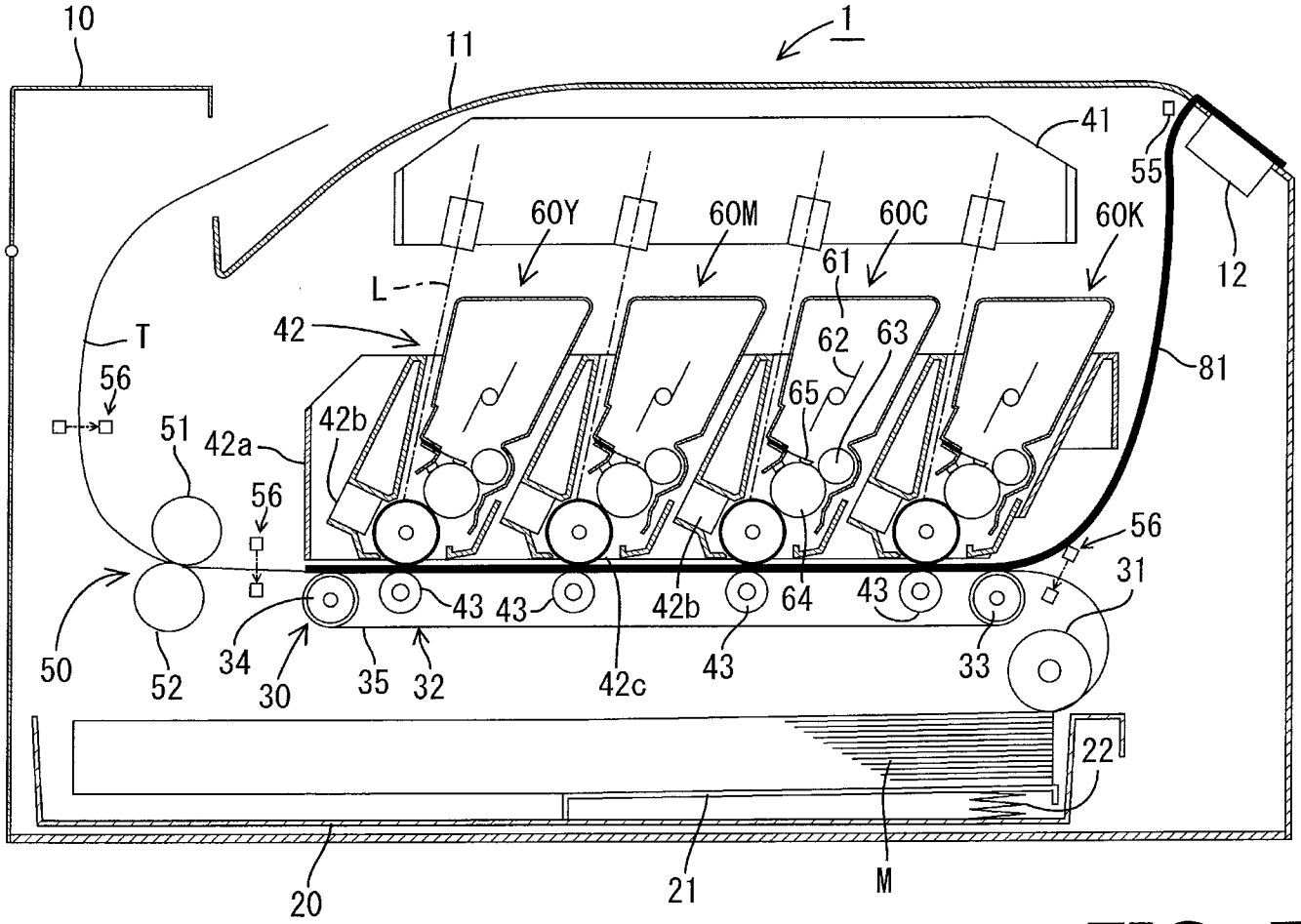
FIG. 5 is a cross-sectional side view of an internal structure of a printer according to a second embodiment of the present invention.

A second embodiment of the present invention will be described with reference to FIGS. 5-8. In the previous embodiment described above, the exemplary configuration, in which the protection sheet 80 covering the toner cartridge attachable section 42*d* prevents the user from attaching the toner cartridge 60, is described. In the second embodiment, the printer 1 has a protection sheet 81 in place of the protection sheet 80. As shown in FIG. 5, the protection sheet 81 is extended to be partially exposed outside the printer 1, and the exposed part covers at least a part of the operation unit 12.

Figure 6:
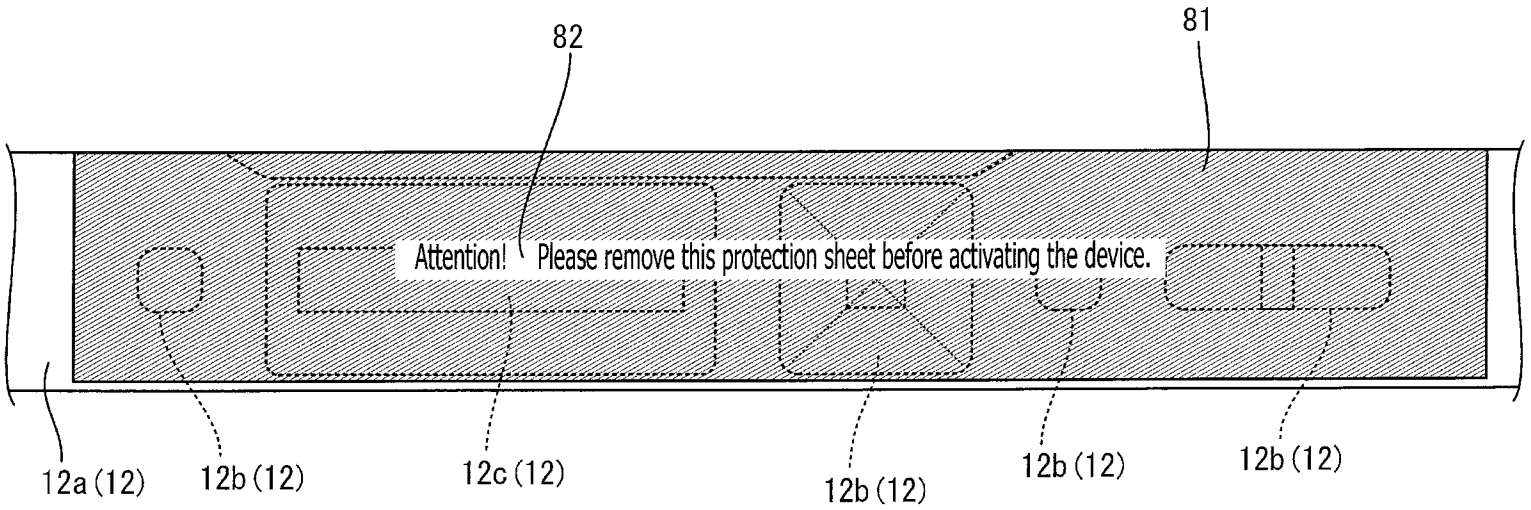
FIG. 6 is an illustrative view of an operation unit covered with a protection sheet in the printer according to the second embodiment of the present invention.

The exposed part of the protection sheet 81 is illustrated in FIG. 6. The protection sheet 81 is made of a non-translucent material and is arranged to cover the operation buttons 12*b* and the liquid crystal display 12*c* so that the user cannot visually recognize the operation buttons 12*b* and the liquid crystal display 12*c*. With the protection sheet 81, therefore, the user is prevented from using the operation unit 12. Accordingly, the user can recognize immediately that the protection sheet 81 should be removed in order to use the operation unit 12.

Additionally, a sign 82, which is to draw the user's attention and instructs the user to remove the protection sheet 81, may be provided on the area of the protection sheet 81 covering the operation unit 12. With the sign 82, the user can be easily aware of the necessity of removing the protection sheet 81.

In FIG. 6, the protection sheet 81 covers the entire operation panel 12*a*; however, the protection sheet 81 may cover a part of the operation panel 12*a*.

Figure 7:
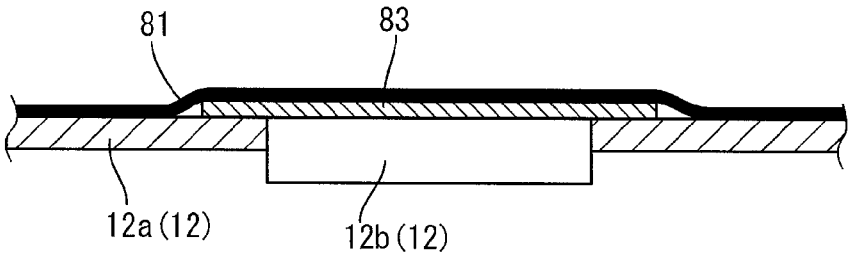
FIG. 7 is an illustrative view of a panel for preventing the operation unit from being used in the printer according to the second embodiment of the present invention.

Optionally, the protection sheet 81 may include a piece of protection panel to prevent the user's operation on the operation panel 12*a*, which may be entered through the protection sheet 81. More specifically, as shown in FIG. 7, a piece of panel 83 made of, for example, resin or metal, which is rigid enough not to be deformed by the user's normal operation to the operation panel 12*a*, may be attached to a lower surface of the protection sheet 81 on a side closer to the operation panel 12*a*. With the panel 83 intervening between the protection sheet 81 and the operation panel 12*a*, the user is inhibited from accessing the operation panel 12*a*, and the operation panel 12*a* is disabled. Thereby, in order to use the operation panel 12*a*, the user can be aware of the necessity of removing the protection sheet 81 even more clearly. It is to be noted that the panel 83 may be attached to an upper surface of the protection sheet 81 on a side farther from the operation panel 12*a*.

Figure 8:
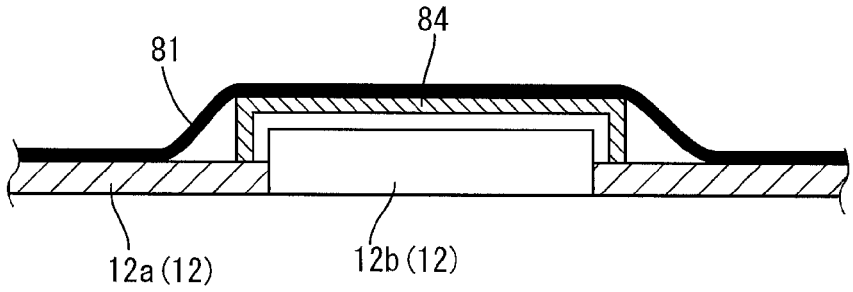
FIG. 8 is an illustrative view of a capping panel for preventing the operation unit from being used in the printer according to the second embodiment of the present invention.

Optionally, a capping panel 84 to disable the operation panel 12*a* may be formed to project upward with respect to a base plane of the operation panel 12*a* (see FIG. 8). With the projecting form, the capping panel 84 may cover the operation buttons 12*b* from above and from sides.

According to the printer 1 described in the second embodiment, the protection sheet 81 is arranged to be exposed outside the printer 1, and the exposed part covers the operation panel 12*a*. Therewith, the user's behavior to use the operation panel 12*a* is interfered. Accordingly, the printer 1 can prevent a printing operation from being started without removing the protection sheet 81.

According to the printer 1 described in the second embodiment, further, with the panel 83 or the panel 84, the printer 1 can prevent the printing operation from being started without removing the protection sheet 81 even more effectively.

Third Embodiment

Figure 9:
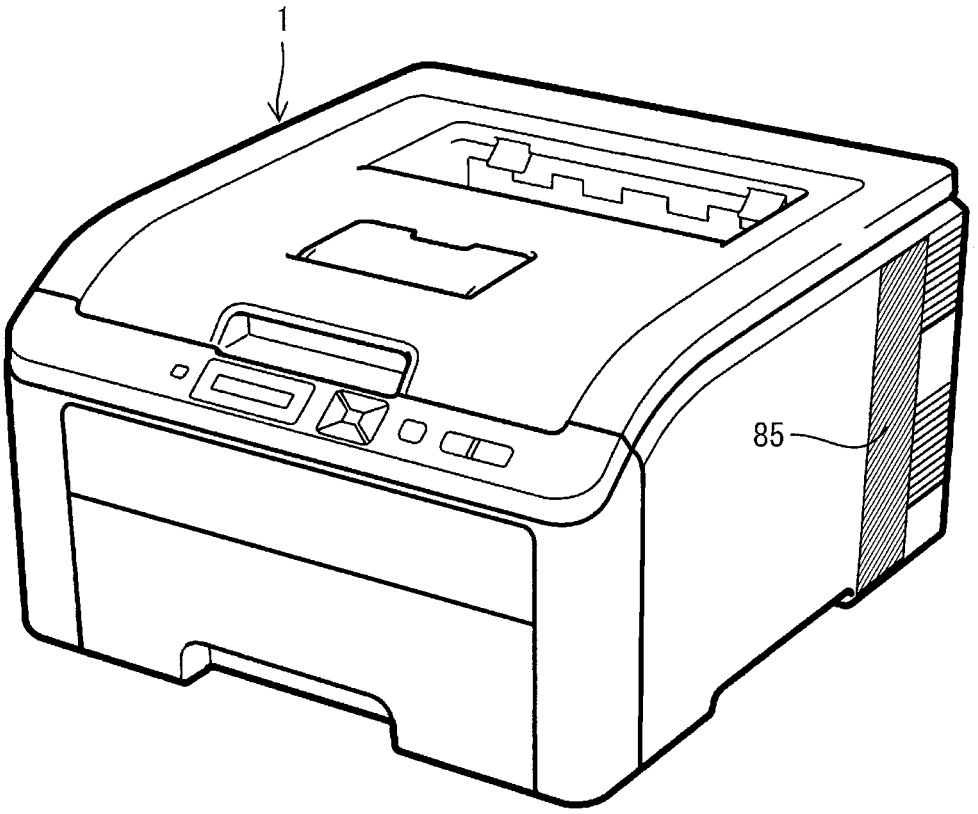
FIG. 9 is a perspective view of a printer according to a third embodiment of the present invention.

A third embodiment of the present invention will be described with reference to FIG. 9. The printer 1 according to the third embodiment is a modified example based on the printer 1 in the second embodiment, in which the protection sheet 81 covers the operation panel 12*a*. In the third embodiment, a protection sheet 85 covering the power switch 12*d* (see FIG. 1) is provided. As has been mentioned above, the power switch 12*d* is a part of the operation unit 12, which can accept various instructions entered by the user.

According to the printer 1 described in the third embodiment, the protection sheet 85 is extended at a part to be exposed outside the printer 1, and the exposed part covers the power switch 12*d*. Therewith, the user's behavior to use the printer 1 is interfered. Accordingly, the printer 1 can prevent a printing operation from being started without removing the protection sheet 85.

Fourth Embodiment

Figure 10:
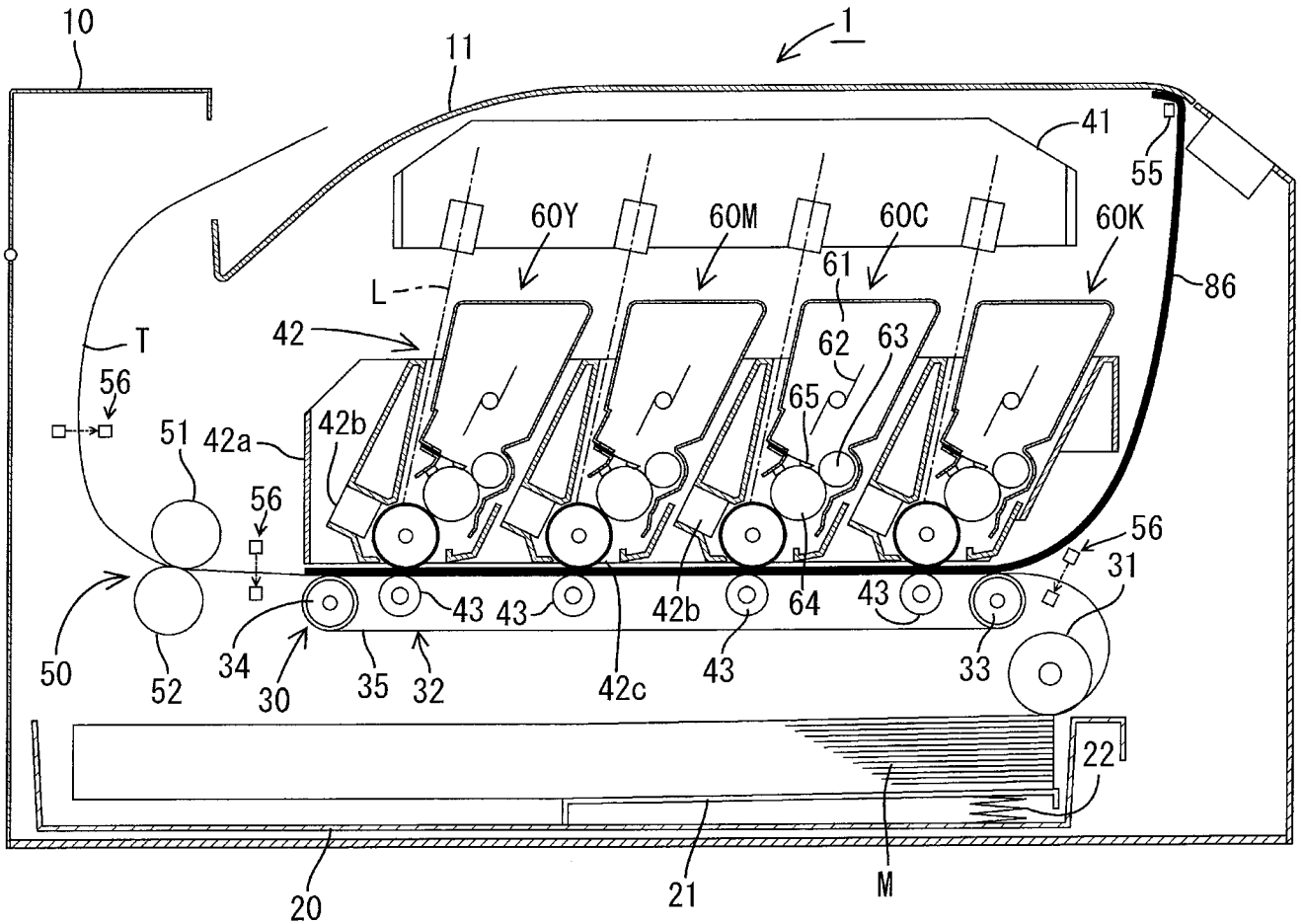
FIG. 10 is a cross-sectional side view of an internal structure of a printer according to a fourth embodiment of the present invention.
Figure 11:
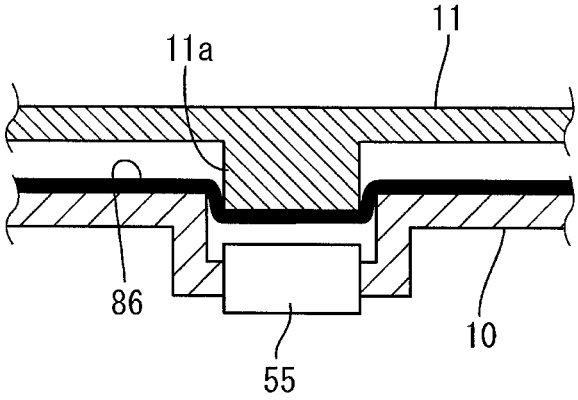
FIG. 11 is an illustrative view of a mechanism of a cover open/close sensor in the printer according to the fourth embodiment of the present invention.

A fourth embodiment of the present invention will be described with reference to FIGS. 10-11. In the fourth embodiment, a protection sheet 86, which can interfere with detecting behaviors of the cover open/close sensor 55, is provided (see FIG. 10).

The protection sheet 86 to interfere the cover open/close sensor 55 with the detecting behaviors will be described with reference to FIG. 11. The cover open/close sensor 55 in the fourth embodiment is a mechanical switch. The cover 11 is formed to have a projection 11*a* in a position to coincide with the cover open/close sensor 55. When the cover 11 is in the closed state, the projection 11*a* presses the cover open/close sensor 55, and detection signals indicating the closed state of the cover 11 are output to the control unit 71.

Meanwhile, the protection sheet 86 is arranged in an intervening position between the projection 11*a* and the cover open/close sensor 55 to cover the cover open/close sensor 55. Therefore, the detecting signals are not output unless the protection sheet 86 is removed out of the printer 1.

When the user enters an instruction to start a printing operation, the control unit 71 supplies electricity to the cover open/close sensor 55. If the detecting signals are not output from the cover open/close sensor 55 after the power supply, that is, if the cover 11 is open, the printing operation is not started. The printing operation is prohibited from being start when the cover 11 is open in a reason that the user should be prevented from touching inner parts in the printer 1, while the printer 1 contains parts, to which high voltage is applied, and which move mechanically during the printing operation, inside the cover 11.

According to the printer 1 described in the fourth embodiment, the protection sheet 86 interferes the cover open/close sensor 55 with the detecting behaviors, and the user is urged to remove the protection sheet 86 in order for the printing operation to be started. Accordingly, the printer 1 can prevent the printing operation from being started without removing the protection sheet 86.

More Examples

Although examples of carrying out the invention have been described, those skilled in the art will appreciate that there are numerous variations and permutations of the printing apparatus that fall within the spirit and scope of the invention as set forth in the appended claims. It is to be understood that the subject matter defined in the appended claims is not necessarily limited to the specific features or acts described above. Rather, the specific features and acts described above are disclosed as example forms of implementing the claims.

For example, in the first embodiment described above, the protection sheet 80 covering the toner cartridge attachable section 42*d* is described. However, the protection sheet may be provided in a different arrangement as long as the user's behavior to install the toner cartridge 60 is interrupted. For example, the protection sheet 80 may be arranged to cover an approximately half area of the opening 10*a* (see FIG. 4). In this arrangement, the user is also prevented from installing the toner cartridge 60 in the printer 1. In other words, the protection sheet 80 may be placed in any arrangement as long as the toner cartridge 60 is interfered with by the protection sheet 80 at any point within an installation path, along which the toner cartridge 60 is inserted to reach the toner cartridge attachable section 42*d*.

For another example, in the second embodiment described above, the operation buttons 12*b* are arranged on the operation panel 12*a*, and the protection sheet 81 is arranged to cover the operation buttons 12*b*. However, the operation buttons 12*b* may be replaced with a touch-sensitive panel, and the touch-sensitive panel may be arranged over the liquid crystal display 12*c*. With the touch-sensitive panel over the liquid crystal display 12*c*, the protection sheet may be extended to cover the touch-sensitive panel. In this regard, the protection sheet should be made of an opaque or non-translucent material in order to prevent the touch-sensitive panel from being seen by the user. Thus, the user is prevented from touching a correct position in the touch-sensitive panel, and the user's behavior to use the operation unit 12 is interfered. For another example, the touch-sensitive panel may be a capacitance-typed touch-sensitive panel, and the protection sheet may be made of a non-conductive material. Thus, the protection sheet may prevent the touch-sensitive panel from reacting even when the user attempts to touch the touch-sensitive panel over the protection sheet. Therefore, the user's behavior to use the operation unit 12 is interfered. When the protection sheet is made of a non-conductive material, the protection sheet 81 may or may not be translucent.

For another example, in the fourth embodiment described above, the protection sheet 86 interfering the cover open/close sensor 55 with the detecting behavior is described. However, the protection sheet may not necessarily interfere with the behavior of the cover open/close sensor 55 but may interfere with a behavior of the sheet-jam sensor 56. For example, a protection sheet made of a non-translucent material may be interposed between the light emitter and the light receiver of the sheet-jam sensor 56 in the detectable range of the sheet-jam sensor 56. Thus, as the sheet-jam sensor 56 detects presence of the protection sheet in the detectable range while no printing operation is conducted, the control unit 71 determines that a sheet M is jammed in the conveyer path T, and a printing operation is prohibited from being conducted. In this way, the user can be aware of the necessity of removing the protection sheet.

In the embodiments described above, the printer 1 is a tandem-typed printer, and the conveyer belt 35 is contiguous with the photosensitive drums 42*c*. However, the printer 1 may be an intermediate-transfer-typed printer, and an intermediate transfer belt may be contiguous with the photosensitive drums 42*c* in place of the conveyer belt 35.

What is claimed is:

1. A printing apparatus configured to print an image on a sheet, comprising:

a photosensitive member;

a contiguous member arranged to contact the photosensitive member;

an operation unit configured to accept an instruction entered by a user; and a protection sheet configured to protect the photosensitive member from the contiguous member, the protection sheet being arranged in an intervening position between the photosensitive member and the contiguous member but configured to be removed from the intervening position by the user before using the printing apparatus, the protection sheet configured to interfere with at least one of the user's behavior conducted on the printing apparatus in order to use the printing apparatus and a detecting behavior of a sensor which is arranged in the printing apparatus to detect a condition of the printing apparatus, the protection sheet being arranged to be partly exposed outside the printing apparatus with the exposed part being arranged to cover at least a part of the operation unit.

2. The printing apparatus according to claim 1, wherein the operation unit includes a power switch; and wherein the protection sheet is arranged to cover the power switch.

3. The printing apparatus according to claim 1, wherein the protection sheet is provided with a member to prevent the user from operating the operation unit and disable the operating unit in an area covering the operating unit.

4. A printing apparatus configured to print an image on a sheet, comprising:

a casing;

a belt unit disposed in the casing, the belt unit including a driving roller, a driven roller, and a conveyer belt extended around the driving roller and the driven roller;

a photosensitive member disposed in the casing;

an operation panel disposed on an outer surface of the casing, the operation panel including a plurality of operation buttons and a display; and a protection sheet, wherein a first part of the protection sheet is arranged in between the photosensitive member and the conveyer belt to prevent the photosensitive member from being in contact with the conveyer belt; and wherein a second part of the protection sheet covers the operation panel.

* * * * *